United States Patent [19]

Sakata et al.

[11] 4,397,936

[45] Aug. 9, 1983

[54] METHOD OF FIXING DEVELOPED ELECTROPHOTOGRAPHIC IMAGES USES OIL ABSORBING SMOOTHING ROLLER

[75] Inventors: Toshio Sakata; Soichi Iwao; Shinji Takiguchi, all of Toyokawa, Japan

[73] Assignee: Minolta Camera Kabushiki Kaisha, Japan

[21] Appl. No.: 330,493

[22] Filed: Dec. 14, 1981

Related U.S. Application Data

[62] Division of Ser. No. 116,605, Jan. 24, 1980, abandoned.

[30] Foreign Application Priority Data

Jan. 30, 1979 [JP] Japan ..... 54-10216

[51] Int. Cl.[3] ..... G03G 13/20; G03G 15/20

[52] U.S. Cl. ..... 430/124; 430/98; 430/99; 430/126; 118/661

[58] Field of Search ..... 430/124, 98, 99, 102, 430/126; 118/661

[56] References Cited

U.S. PATENT DOCUMENTS 4,214,549 7/1980 Moser ..... 430/99

*Primary Examiner*—John D. Welsh

*Attorney, Agent, or Firm*—Wenderoth, Lind & Ponack

[57] ABSTRACT

A fixing apparatus for use in a copying machine and the like which includes upper and lower fixing rollers suitably heated and contacting each other for simultaneous rotation to define a path between them through which copy paper sheets to be fixed pass, applicator member for applying offset prevention solution to one of the fixing rollers, and a smoothing roller with oil absorbing property arranged to contact under pressure the surface of the one of the fixing rollers applied with the offset prevention solution for simultaneous rotation. The smoothing roller is arranged to function to absorb excessive offset prevention solution applied onto the surface of the one of the fixing rollers and also to uniformly distribute the offset prevention solution adhering to the surface of the one of the fixing rollers.

12 Claims, 3 Drawing Figures

METHOD OF FIXING DEVELOPED ELECTROPHOTOGRAPHIC IMAGES USES OIL ABSORBING SMOOTHING ROLLER

This is divisional of Ser. No. 116,605, filed Jan. 24, 1980, now abandoned.

BACKGROUND OF THE INVENTION

The present invention generally relates to a fixing apparatus and more particularly, to a fixing or fusing apparatus, for example, for use in an electrophotographic copying machine arranged to apply an offset phenomenon prevention liquid or solution such as silicone oil and the like onto the peripheral surfaces of fixing rollers through applicator means.

Generally, in the fixing or fusing apparatus, for example, of heat-pressure or roll type commonly employed for fixing or fusing developed toner powder images of an original formed by a copying machine in a known manner onto copy material such as copy paper sheets, and including upper and lower fixing rollers contacting each other for simultaneous rotation, with proper heating means provided therein, when silicone oil or the like as a solution for preventing the undesirable offset phenomenon is applied onto the surface of one of the fixing rollers by the applicator means, the amount of silicone oil adhering to the surface of the fixing roller tends to remain unevenly distributed over said surface, and if the unfixed toner powder images formed on the copy paper sheet are to be fused in the above state as the copy paper sheet is passed between the upper and lower fixing rollers, various problems related to excessive application of the silicone oil such as soiling of the copy paper sheets, wetting and swelling of silicone rubber layers or the like of the fixing rollers, etc. are likely to take place.

In order to overcome the disadvantages as described above, the present inventors have already proposed a fixing apparatus of silicone oil application system as shown in FIG. 1 which includes an upper fixing roller 4 of silicone oil impregnation type constituted by a cylindrical metallic core member 1 covered with a thin silicone rubber layer 2 applied onto its peripheral surface and having a heater member 3 incorporated therein for heating its surface, a lower fixing roller 7 also of the silicone oil impregnation type constituted by a cylindrical metallic core member 5 covered with a thick silicone rubber layer 6 applied onto its peripheral surface, with the lower fixing roller 7 being adapted to rotate in the direction indicated by the arrow "b" following rotation of the upper fixing roller 4 in the direction of the arrow "a" by suitable driving means (not shown), an offset prevention solution supplying and applicator member 10 immersed at its one end in the silicone oil 9 contained in a tank 8, intermittent application means (not shown) which causes the member 10 to contact, under a predetermined pressure, an applicator roller 11 kept in contact with the lower fixing roller 7 so as to follow the rotation of said roller 7, only during one rotation of the applicator roller 11 for each copying of one copy paper sheet and which brings said member 10 back to the original position spaced from the applicator roller 11 after the one rotation of said roller 11 for supplying the silicone oil 9 thus applied onto the applicator roller 11 further to the upper fixing roller 4 through the lower fixing roller 7 so as to make it possible to fix the unfixed toner images on the copy paper sheet P passed between said rollers 4 and 7, and a blade 12 arranged to contact the surface of the applicator roller 11 for scraping off excessive silicone oil 9 remaining on said roller 11 so as to be again collected in the tank 8.

The fixing apparatus of FIG. 1 further includes a metallic roller 13 arranged to contact under pressure by suitable urging means (not shown), the surface of the lower fixing roller 7 supplied with the silicone oil 9 by the applicator roller 11 for rotation in the direction of the arrow "c" following the rotation of the lower fixing roller 7, so that the silicone oil 9 applied onto the surface of the lower fixing roller 7 is smoothed or uniformly distributed over said surface to be further supplied to the upper fixing roller 4 for elimination of the problems mentioned earlier. More specifically, in the above arrangement, it is so arranged that the silicone oil unevenly adhering to the surface of the lower fixing roller 7 is uniformly or evenly distributed all over the surface of said roller 7.

However, according to experiments carried out by the present inventors in a manner as described below, it has been fouund that, when the silicone oil is uniformly distributed by the roller 13 in the fixing apparatus as described above, although no particular problem is encountered in fixing copy paper sheets of the same size, soiling due to traces of silicone oil is noticed on the fixed copy paper sheets upon alteration of copy paper size.

More specifically, in the experiments carried out by the use of the fixing apparatus as described above, when copy paper sheets of B4 size were passed after one hundred copy paper sheets of A4 size had been fixed, the soiling due to traces of silicone oil appeared at opposite edge portions of the B4 size copy paper sheets exceeding the A4 size.

Accordingly, it has been found by the present inventors that, in the fixing apparatus of silicone oil application system, particularly in one intended to deal with copy paper sheets of different sizes, the problem related to the soiling due to the traces of silicone oil appearing at such edge portions must be solved besides achieving the uniform distribution of the silicone oil applied onto the fixing rollers.

In connection with the above, the present inventors have concluded that the above problem of soiling due to traces of oil is attributable to the fact that, as shown in FIG. 2, while the silicone oil adhering to the fixing rollers 7 and 4 is consumed by degrees at a central portion C of the path defined between the rollers 7 and 4 as copy paper sheets of small size, for example, A4 size are passed therethrough, the silicone oil at edge portions E other than the central portion C is not consumed and gradually becomes excessive through accumulation, and that even the metallic roller or smoothing roller 13 can not adjust the excessive silicone oil at the edge portions E to a proper amount required for preventing the undesirable offset phenomenon.

SUMMARY OF THE INVENTION

Accordingly, an essential object of the present invention is to provide an improved fixing apparatus arranged to apply an offset prevention solution onto fixing roller surfaces which is capable of smoothly or uniformly distributing the offset prevention solution over the fixing roller surfaces without formation of soiling due to traces of the offset prevention solution irrespective of copy paper sizes to be dealt with.

Another important object of the present invention is to provide an improved fixing apparatus of the above described type in which a smoothing roller having oil absorbing property is employed.

A further object of the present invention is to provide an improved fixing apparatus of the above described type which is simple in construction and stable in functioning, and can readily be incorporated into copying apparatuses of the kind at low cost.

In accomplishing these and other objects, according to one preferred embodiment of the present invention, there is provided a fixing apparatus for use in a copying machine and the like which includes upper and lower fixing rollers provided with heating means and contacting each other for simultaneous rotation to define a path therebetween through which copy paper sheets to be fixed pass, applicator means for applying offset prevention solution to one of said fixing rollers, and a smoothing roller with oil absorbing property arranged to contact under pressure the surface of the one of said fixing rollers applied with the offset prevention solution for simultaneous rotation therewith. The smoothing roller is arranged to function to absorb excessive offset prevention solution applied onto the surface of the one of said fixing rollers and also to uniformly distribute the offset prevention solution adhering to the surface of the one of said fixing rollers over said surface.

By the above arrangement according to the present invention, the offset prevention solution is evenly distributed over the surface of the fixing roller without causing soiling due to traces of the solution, regardless of the copy paper sizes to be dealt with, with substantial elimination of disadvantages inherent in the conventional fixing apparatuses of the kind.

BRIEF DESCRIPTION OF THE DRAWINGS

These and other objects and features of the present invention will become apparent from the following description taken in conjunction with the preferred embodiment thereof with reference to the accompanying drawings in which.

Before the description of the present invention proceeds, it is to be noted that like parts are designated by like reference numerals throughout views of the accompanying drawings.

DETAILED DESCRIPTION OF THE INVENTION

Figure 1:
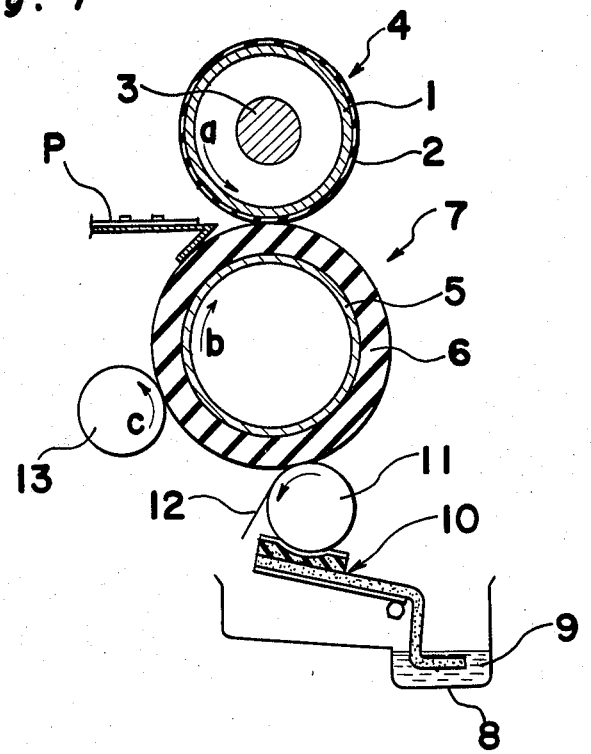
FIG. 1 is a schematic side sectional view of a fixing apparatus of offset prevention solution applicating system to which the present invention may be applied (already referred to)

Referring to the drawings, the present invention will be described in detail hereinbelow.

It is to be noted that the present invention is mainly related to the improvement of the offset prevention solution smoothing roller which may be applied to a fixing apparatus having the construction as described with reference to FIG. 1, and therefore, detailed description of the general structure of the fixing apparatus is abbreviated here for brevity.

Figure 3:
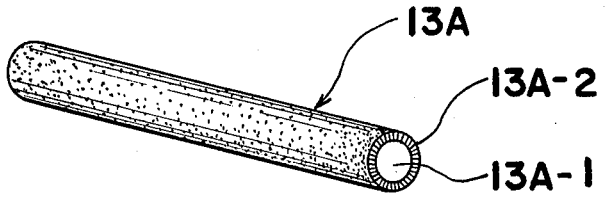
FIG. 3 is a perspective view showing the structure of an improved offset prevention solution smoothing roller directly related to the present invention.

Referring particularly to FIG. 3, there is shown an offset prevention solution smoothing roller 13A directly related to the present invention by which the distribution roller 13 of FIG. 1 is to be replaced. The smoothing roller 13A of FIG. 3 is particularly imparted with oil absorbing function, and comprises a core member 13A-1 and a layer 13A-2 having oil absorbing property and applied onto the outer periphery of the core member 13A-1 as shown. The core member 13A-1 is preferably be made of a rigid material such as metal, but other materials having hardness to a certain extent and levelling or smoothing function suitable for smoothing the silicone oil as the offset prevention solution may be employed. Meanwhile, for the layer 13A-2 with oil absorbing property, laminated layers of paper web, expanded polyurethane rubber, NBR (acrylonitrile-butadiene rubber) group rubber having minute continuous pores formed therein, and artificial leather, etc. may be used, but any materials having oil absorbing property to a certain extent may also be employed.

Hereinbelow, EXAMPLES are inserted for the purpose of illustrating the present invention, without any intention of limiting the scope thereof.

EXAMPLE I

For the smoothing roller having oil absorbing function, the following four kinds of samples were prepared.

(i) a roller R1 of 15 $\phi$ in external diameter prepared by winding paper web (HOP 250 produced by Oji Paper Co., Ltd., Japan) of 100$\mu$ in thickness up to a thickness of 2.5 mm onto an iron core of 10 $\phi$ in diameter.

(ii) a sponge roller R2 of 15 $\phi$ in external diameter prepared by fitting expanded polyurethane rubber material in tubular form (with external diameter of 15 $\phi$, internal diameter of 7 $\phi$ and thickness of 4 mm, produced by Kinyosha Kabushiki Kaisha, Japan) onto an iron core of 7 $\phi$ in diameter.

(iii) a roller R3 of 23 $\phi$ in external diameter prepared by winding NBR (acrylonitrile-butadiene rubber) group rubber material (Vanpola form 2H50, produced by Bando Chemical Industries, Ltd., Japan) having minute continuous foams formed therein onto an iron core of 17 $\phi$ in diameter to a thickness of 3 mm.

(iv) a roller R4 of 21 $\phi$ in external diameter prepared by winding artificial leather material (velour type, #3910-0402, Kuraray Co., Ltd., Japan) onto an iron core of 17 $\phi$ in diameter to a thickness of 2 mm.

Each of the above four kinds of rollers R1 to R4 was employed to replace the metallic roller 13 in the arrangement of FIG. 1 for carrying out experiments as follows.

Figure 2:
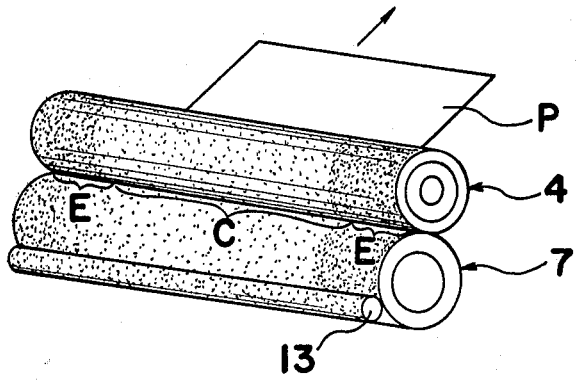
FIG. 2 is a perspective view of upper and lower fixing rollers and a metallic offset prevention solution smoothing roller employed in the fixing apparatus of FIG. 1, which is explanatory of the function of the smoothing roller (already referred to)

In the experiments, immediately after continuously fixing one hundred sheets of A4 size copy paper, copy paper sheets of B4 size were passed through the fixing apparatus to examine whether silicone oil adhered to the edge portions E of the B4 size copy paper sheets exceeding the A4 size as in FIG. 2, with respect to initial state of fixing and the state after fixing fifty thousand sheets of B4 size copy paper. In the above case, the amount of silicone oil applied to the lower fixing roller 7 was approximately 10 mg per one copy paper sheet.

As a result of the above experiments, no soiling due to traces of silicone oil was noticed at the edge portions E of the B4 size copy paper sheets in the case where any of the above four kinds of rollers R1 to R4 was employed, and thus, it was confirmed that these four kinds of rollers R1 to R4 were high in performance as smoothing rollers having the silicone oil absorbing property, with favorable fixing of at least fifty thousand sheets being guaranteed.

Moreover, with reference to the roller R1 of the above item (i), a similar experiment as in EXAMPLE 1 was again carried out after passing another fifty thousand sheets of B4 size copy paper (hundred thousand sheets in total), and as a result, no traces of silicone oil were noticed at the opposite edges E of the B4 size copy paper sheets. Furthermore, upon examination of the state of the surface of the roller R1 after the above repeated experiment by visual examination and depression by finger tips, it was ensured that the silicone oil was distributed approximately uniformly over the entire width of the roller R1.

EXAMPLE II

With a metallic roller and the roller R1 employed as the smoothing rollers, the fixing apparatus was subjected to an idle operation (i.e. operation with the silicone oil applied, but without passing copy paper sheets therethrough) equivalent to fixing of one hundred copy paper sheets, and thereafter, the state of adhesion of the silicone oil onto the smoothing rollers and lower fixing roller was visually examined as well as the soiling due to traces of the silicone oil after passing of copy paper sheets therethrough. The results of the above visual examination are given in Table 1 below.

TABLE 1

| | Adhesion of silicone oil to smoothing rollers and lower fixing roller. | Soiling of copy paper sheets due to traces of silicone oil. |
|---|---|---|
| Metallic roller | Silicone oil layers approximately equal in the amount of adhesion was noticed both on the metallic roller and lower fixing roller | Soiling due to traces of silicone oil was noticed on entire surface |
| Roller R1 | Although silicone oil layers approximately equal in the amount of adhesion were noticed on the surfaces of the roller R1 and lower fixing roller, the amount was small as compared with the case of the above metallic roller. | No soiling due to traces of silicone oil was noticed. |

EXAMPLE III

The roller R1 subjected to the above EXAMPLE II was arranged to contact a metallic roller under pressure for rotation following the rotation of the metallic roller, with a cleaning pad contacting under pressure said metallic roller. In the above state, the surface of the metallic roller between the roller R1 and a point facing the cleaning pad was carefully observed. As a result, it was ensured that the silicone oil oozing out from the roller R1 was continuously supplied onto the metallic roller for a time period during which several tens of copy paper sheets may be copied so far as the state can be observed through visual examination.

By the above experiment, it is understood that the smoothing roller directly related to the present invention functions to absorb excessive silicone oil, while imparting the silicone oil thus absorbed to portions with too little oil, and also to uniformly distribute the silicone oil by its absorbing layer in the case where the silicone oil was unevenly absorbed in the widthwise direction of copy paper sheets. Accordingly, in cases where copy paper sheets of B4 size are fixed after continuous fixing of A4 size copy paper sheets, etc., the smoothing roller 13A in FIG. 3 is considered to function to absorb the excessive silicone oil at the edge portion E for uniform diffusion thereof in the absorbing layer 13A-2, and simultaneously, to impart the silicone oil to the central portion C having excessively small amount of the silicone oil so as to maintain the amount of the silicone oil fed towards the contact portion between the copy paper sheets and fixing rollers constant at all times.

EXAMPLE IV

In the arrangement of EXAMPLE I, various different materials were employed for the applicator member 10 so as to vary the amount of application of the silicone oil for ensuring a range permissible for optimum fixing when the roller R1 was employed, as a result of which it has been found that the amount of application of at least 5~30 mg/one sheet of A4 size gives a favorable fixing.

Subsequently, in the similar experiments carried out with the thickness of the layer 13A-2 (paper web) altered to 1.0, 1.5, 3 and 5 mm respectively, it was ensured that the results were all favorable.

As is seen from the foregoing EXAMPLES, each of the rollers R1, R2, R3 and R4 does not absorb all of the silicone oil 9 applied onto the surface of the lower fixing roller 7, but leaves the silicone oil in the amount necessary for the offset prevention by the uniform smoothing function thereof, although it absorbs the excessive silicone oil at the edge portions E. Therefore, the smoothing roller 13A according to the present invention is utterly different from the conventional absorbing rollers and the like having functions merely to absorb oil.

Furthermore, the layer 13A-2 having silicone oil absorbing property of the smoothing roller 13A according to the present invention is considered to be capable of repeating its absorbing function by again imparting its absorbed silicone oil to the lower fixing roller 7 as the smoothing roller 13A is pressed against the lower fixing roller 7 by the urging means as mentioned with reference to the smoothing roller 13 of FIG. 1, although the layer 13A-2 may be gradually saturated with the silicone oil. Therefore, the thickness of the silicone oil absorbing layer 13A-1 may be thinner or thicker than those in the EXAMPLE stated earlier, for application over a comparatively wide range.

It should be noted here that the present invention is not limited in its application to the silicone oil application system fixing apparatus of FIG. 1 alone, in which the silicone oil is intermittently applied to the lower fixing roller but may readily be applicable to a fixing apparatus arranged to apply the silicone coil to the upper fixing roller or to apply the silicone oil continuously either to the lower fixing roller or upper fixing roller.

As is clear from the foregoing description, according to the present invention, the fixing apparatus which applies the offset prevention solution to the surfaces of the fixing rollers is so arranged that the offset prevention solution smoothing roller having silicone oil absorbing property contacts for rotation with respect to the surface of the fixing roller applied with the offset prevention solution for absorbing the excessive solution adhering to the fixing roller surface and simultaneously for smoothing the offset prevention solution over said fixing roller surface. Therefore, various problems inherent in the conventional applicator members such as soiling of copy paper sheets arising from excessive application due to non-uniform or uneven distribution of the silicone oil on the fixing roller, swelling of the silicone rubber layer through wetting, and further, the soiling due to traces of silicone oil at the edge portions of the copy sheets taking place upon changing of the copy paper sizes, etc. have been advantageously eliminated.

Although the present invention has been fully described by way of examples with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A method for fixing developed toner powder images onto copy paper sheets in an apparatus comprising upper and lower fixing rollers, an applicator means and a smoothing roller which method comprises:

a. passing said copy paper sheets to be fixed between said upper and lower fixing rollers, at least one of which being provided with heating means and which rollers contact each other for simultaneous rotation, b. applying an oily offset prevention solution to one of said fixing rollers by said applicator means in direct contact therewith and, c. contacting under pressure the one of said fixing rollers having said oily offset prevention solution applied thereto with a smoothing roller arranged for simultaneous rotation with said fixing rollers, said smoothing roller having an oil absorbing property, and said smoothing roller absorbing any excess offset prevention solution applied onto the surface of one of said fixing rollers and also uniformly distributing the offset prevention solution adhering to the surface of one of said fixing rollers over said surface.

2. The method as claimed in claim 1, wherein said smoothing roller has a layer having the oil absorbing property provided on the surface thereof.

3. The method as claimed in claim 1, wherein said smoothing roller further includes a metallic core member and a layer having the oil absorbing property and covering the peripheral surface of said metallic core member.

4. The method as claimed in claim 3, wherein said layer having the oil absorbing property is made of laminated layers of paper web.

5. The method as claimed in claim 3, wherein said layer having the oil absorbing property is made of expanded polyurethane rubber.

6. The method as claimed in claim 3, wherein said layer having the oil absorbing property is made of NBR group rubber having minute continuous pores formed therein.

7. The method as claimed in claim 3, wherein said layer having the oil absorbing property is made of artificial leather.

8. The method as claimed in claim 1, wherein said one of the fixing rollers to be applied with the offset prevention solution by said applicator means is the lower fixing roller.

9. The method as claimed in claim 1, wherein said one of the fixing rollers to be applied with the offset prevention solution by said applicator means is the upper fixing roller.

10. The method as claimed in claim 1, wherein said applicator means is arranged to intermittently apply the offset prevention solution onto said one of said fixing rollers.

11. The method as claimed in claim 1, wherein said applicator means is arranged to continuously apply the offset prevention solution onto said one of said fixing rollers.

12. The method as claimed in claim 1 wherein said applicator means contacting said fixing roller comprises a roller arranged for simultaneous rotation with said fixing roller.

* * * * *